US008717272B2

(12) United States Patent
Kim

(10) Patent No.: US 8,717,272 B2
(45) Date of Patent: May 6, 2014

(54) SCAN DRIVER AND ORGANIC LIGHT EMITTING DISPLAY DEVICE

(75) Inventor: Yang Wan Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 2005 days.

(21) Appl. No.: 11/594,408

(22) Filed: Nov. 7, 2006

(65) Prior Publication Data

US 2007/0124633 A1 May 31, 2007

(30) Foreign Application Priority Data

Nov. 9, 2005 (KR) ..... 10-2005-0107197
Nov. 9, 2005 (KR) ..... 10-2005-0107198

(51) Int. Cl.
*G09G 3/36* (2006.01)

(52) U.S. Cl.
USPC ..... 345/98; 345/92; 345/55; 345/39

(58) Field of Classification Search
USPC ..... 345/98, 92, 55, 39
See application file for complete search history.

(56) References Cited

U.S. PATENT DOCUMENTS 7,440,702 B2 * 10/2008 Imai ..... 398/141
2004/0196239 A1 * 10/2004 Kwon ..... 345/92

FOREIGN PATENT DOCUMENTS

| | | |
|---|---|---|
| JP | 2003-202833 | 7/2003 |
| JP | 2003-224437 | 8/2003 |
| JP | 2005-031630 | 2/2005 |
| JP | 2005-43470 | 2/2005 |
| JP | 2005-43882 | 2/2005 |
| JP | 2005-157283 | 6/2005 |
| JP | 2005-157308 | 6/2005 |
| JP | 2005-258436 | 9/2005 |
| KR | 2003-0075946 | 9/2003 |
| KR | 10-2003-0096900 | 12/2003 |
| KR | 10-2004-0008684 | 1/2004 |
| KR | 10-2004-0085653 | 10/2004 |
| KR | 10-2005-0014124 | 2/2005 |
| KR | 10-2005-0051070 | 6/2005 |

OTHER PUBLICATIONS

Korean Patent Abstracts, Publication No. 1020030075946 A, dated Sep. 26, 2003, in the name of O Gyeong Kwon, et al.
Korean Patent Abstracts, Publication No. 1020050014124 A, dated Feb. 7, 2005, in the name of Dong Yong Shin.

(Continued)

*Primary Examiner* — William Boddie
*Assistant Examiner* — Leonid Shapiro
(74) *Attorney, Agent, or Firm* — Christie, Parker & Hale, LLP

(57) ABSTRACT

An organic light emitting display device includes a scan driver for supplying a first scan signal to a first scan line during a first period and a second period, a second scan signal to a second scan line during the second period, and a light emitting control signal to a light emitting control line during a period at least spanning the first and second periods. A data driver sequentially supplies data signals to an output line during the first period. A demultiplexer is electrically coupled to the output line, receives the data signals and supplies the data signals to data lines which are connected to pixels. Each pixel receives one of the data signals during the first period, compensates a threshold voltage of a driving transistor during the second period, and generates light with a brightness corresponding to the one of the data signals after the second period.

18 Claims, 9 Drawing Sheets

(56) References Cited

OTHER PUBLICATIONS

Patent Abstracts of Japan, Publication No. 2003-224437, Published on Aug. 8, 2003, in the name of Sano.
Patent Abstracts of Japan, Publication No. 2005-043470, Published on Feb. 17, 2005, in the name of Tsujino et al.
Patent Abstracts of Japan, Publication No. 2005-043882, Published on Feb. 17, 2005, in the name of Hatano et al.
Korean Patent Abstracts, Publication No. 1020030096900 A, Published on Dec. 31, 2003, in the name of Shin.
Korean Patent Abstracts, Publication No. 1020040008684 A, Published on Jan. 31, 2004, in the name of Choi.
Korean Patent Abstracts, Publication No. 1020040085653 A, Published on Oct. 8, 2004, in the name of Kwon.
Korean Patent Abstracts, Publication No. 1020050051070 A, Published on Jun. 1, 2005, in the name of Shin.

* cited by examiner

SCAN DRIVER AND ORGANIC LIGHT EMITTING DISPLAY DEVICE

CROSS-REFERENCE TO RELATED APPLICATIONS

This application claims priority to and the benefit of Korean Patent Application Nos. 10-2005-0107197 and 10-2005-0107198, both filed on Nov. 9, 2005, in the Korean Intellectual Property Office, the entire contents of which are incorporated herein by reference.

BACKGROUND

1. Field of the Invention

The present invention relates to a scan driver and an organic light emitting display device, and, more particularly, to a scan driver and an organic light emitting display device which uses a reduced number of data driver output lines.

2. Discussion of Related Art

One type of flat panel display device is an organic light emitting display device which displays images by using an organic light emitting diode (OLED). The OLED generates light by recombining electrons and holes. Advantages of the organic light emitting display device include rapid response speed and low consumption of power.

FIG. 1 is a diagram showing a conventional organic light emitting display device.

Referring to FIG. 1, the conventional organic light emitting display device includes a display region 30 including a plurality of pixels 40, each of which is arranged to be connected to one of scan lines S1, S2, . . . , Sn and to one of data lines D1, D2, . . . , Dm, a scan driver 10 for driving the scan lines S1, S2, . . . , Sn, a data driver 20 for driving the data lines D1, D2, . . . , Dm, and a timing controller 50 for controlling the scan driver 10 and the data driver 20.

The scan driver 10 generates scan signals according to scan driving control signals SCS received from the timing controller 50, and sequentially supplies the scan signals to the scan lines S1, S2, . . . Sn. In addition, the scan driver 10 generates light emitting control signals according to the scan driving control signals SCS, and sequentially supplies the light emitting control signals to light emitting control lines E1, E2, . . . , En.

The data driver 20 generates data signals according to data driving control signals DCS received from the timing controller 50, and sequentially supplies the data signals to the data lines D1, D2, . . . , Dm. The data signals are synchronized with the scan signals.

The timing controller 50 generates the data driving control signals DCS and the scan driving control signals SCS according to synchronization signals, which may be externally provided. The data driving control signals DCS are supplied to the data driver 20, and the scan driving control signals SCS are supplied to the scan driver 10. The timing controller 50 receives data, which may be externally provided, and then supplies the data to the data driver 20.

The display region 30 is receives a voltage corresponding to a first power source ELVDD and a voltage corresponding to a second power source ELVSS (which may be external sources). The voltages corresponding to the first power source ELVDD and the second power source ELVSS are supplied to the pixels 40. Each of the pixels receives the voltages and generates light according to the data signals that it receives. Durations of periods in which the pixels 40 generate light are controlled according to the light emitting control signals.

As such, each of the pixels 40 is located near intersections of the scan lines S1, S2, . . . , Sn and the data lines D1, D2, . . . , Dm. The data driver 20 drives m output lines in order to supply data signals to m data lines D1, D2, . . . , Dm. That is, the data driver 20 of the conventional organic light emitting display device drives a plurality of output lines equal in number to that of the data lines D1, D2, . . . , Dm. Accordingly, multiple data driving circuits may be included in the data driver 20 so that the data driver 20 can drive m output lines, which may lead to increased manufacturing costs. In particular, as a resolution and a size (e.g., in inches) of an organic light emitting display device increase, a data driver 20 of the conventional organic light emitting display device is required to drive a correspondingly higher number of output lines, which may further increase manufacturing costs.

SUMMARY OF THE INVENTION

An aspect of the present invention is to provide a scan driver and a organic light emitting display device, in which a number of output lines of a data driver can be reduced.

According to an embodiment of the present invention, an organic light emitting display device includes a scan driver for sequentially supplying first scan signals to first scan lines, sequentially supplying second scan signals to second scan lines, and sequentially supplying light emitting control signals to light emitting control lines. The scan driver supplies one of the first scan signals to a first scan line of the first scan lines during a first period and a second period of a horizontal period. The scan driver supplies one of the second scan signals to a second scan line of the second scan lines during the first period. The scan driver supplies one of the light emitting control signals to a corresponding one of the light emitting control lines during a period at least spanning the first period and the second period. A data driver supplies in a sequential order a plurality of data signals to at least one of a plurality of output lines. The data driver supplies the data signals to the at least one of the output lines during the first period. A demultiplexer is electrically coupled to the at least one of the output lines. The demultiplexer receives the data signals and supplies the data signals to a plurality of data lines. A plurality of pixels are connected to the data lines. Each of the pixels includes a driving transistor. Each of the pixels receives a respective one of the data signals during the first period, compensates a threshold voltage of the respective driving transistor during the second period, and generates light having a brigntness corresponding to the respective one of the data signals after the end of the second period.

In one embodiment, the demultiplexer includes a plurality of switching elements. Each of the switching elements is connected to the at least one of the output lines and to a respective one of the data lines.

In a further embodiment, the organic light emitting display device further includes a demultiplexer controller for supplying control signals to the demultiplexer. The control signals sequentially turn on the plurality of switching elements during the first period.

In one embodiment, the data driver supplies to the at least one of the output lines a dummy data signal during the second period. The brightness of light generated by each of the pixels does not correspond to the dummy signal supplied during the second period.

In one embodiment, each of the pixels further includes an organic light emitting diode in addition to the driving transistor which has a first electrode, a second electrode and a gate electrode. Each of the pixels further includes a second transistor, a third transistor, a fourth transistor, a fifth transistor and a storage capacitor. Each of the second, third, fourth, and fifth transistors has a first electrode, a second electrode and a gate electrode. The storage capacitor has a first terminal and a second terminal. The second transistor is connected to a corresponding first scan line of the first scan lines and to a corresponding data line of the data lines. The second transistor turns on when a first scan signal of the first scan signals is supplied to the corresponding first scan line of the first scan lines and supplies a data signal on the corresponding data line of the data lines to a first node. The first terminal of the storage capacitor is connected to the first node, and the second terminal of the storage capacitor is connected to a second node. The driving transistor supplies a current corresponding to a value of a voltage applied to the second node via the organic light emitting diode to a power source. The third transistor is connected between the second node and the second electrode of the driving transistor. The third transistor turns on when the first scan signal of the first scan signals is supplied to the corresponding first scan line of the first scan lines and connects the driving transistor in a diode form. The fourth transistor is connected between the second electrode of the driving transistor and an initialization power source. The fourth transistor turns on when a second scan signal of the second scan signals is supplied to a corresponding second scan line of the second scan lines. The fifth transistor is connected between the first node and the initialization power source. The fifth transistor turns on when the light emitting control signal is not supplied to a corresponding light emitting control line of the light emitting control lines.

In an embodiment of the present invention, the scan driver includes a plurality of shift registers for sequentially generating sampling pulses and also includes a plurality of shift generation parts. Each of the shift generation parts generates a respective first scan signal of the first scan signals, a respective second scan signal of the second scan signals, and a respective light emitting control signal of the light emitting control signals by performing logic operations on sampling pulses produced by two adjacent shift registers of the plurality of shift registers. Each of the signal generation parts includes a first NAND gate for generating the respective first scan signal by performing logic operation on the sampling pulses produced by the two adjacent shift registers, a first NOR gate for generating the respective light emitting control signal by performing logic operation on the sampling pulses produced by the two adjacent shift registers, and a second NOR gate for generating the respective second scan signal by performing logic operation on an output of the first NAND gate and an externally provided enable signal.

In one embodiment, the shift registers are driven by clock signals and clock bar signals and separated into a first group and a second group. The shift registers of the first group are driven by rising edges of the clock signals, and the shift registers of the second group are driven by falling edges of the clock signals. The shift registers of the first group and the shift registers of the second group are alternately arranged.

A duration of a period of the enable signal may be configured to be substantially equal to ½ of a period of the clock signal.

In one embodiment, the period of the enable signal has a first portion and a second portion. The enable signal has a high logic output during the first portion and a low logic output during the second portion. The first portion is shorter in duration than the second portion.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
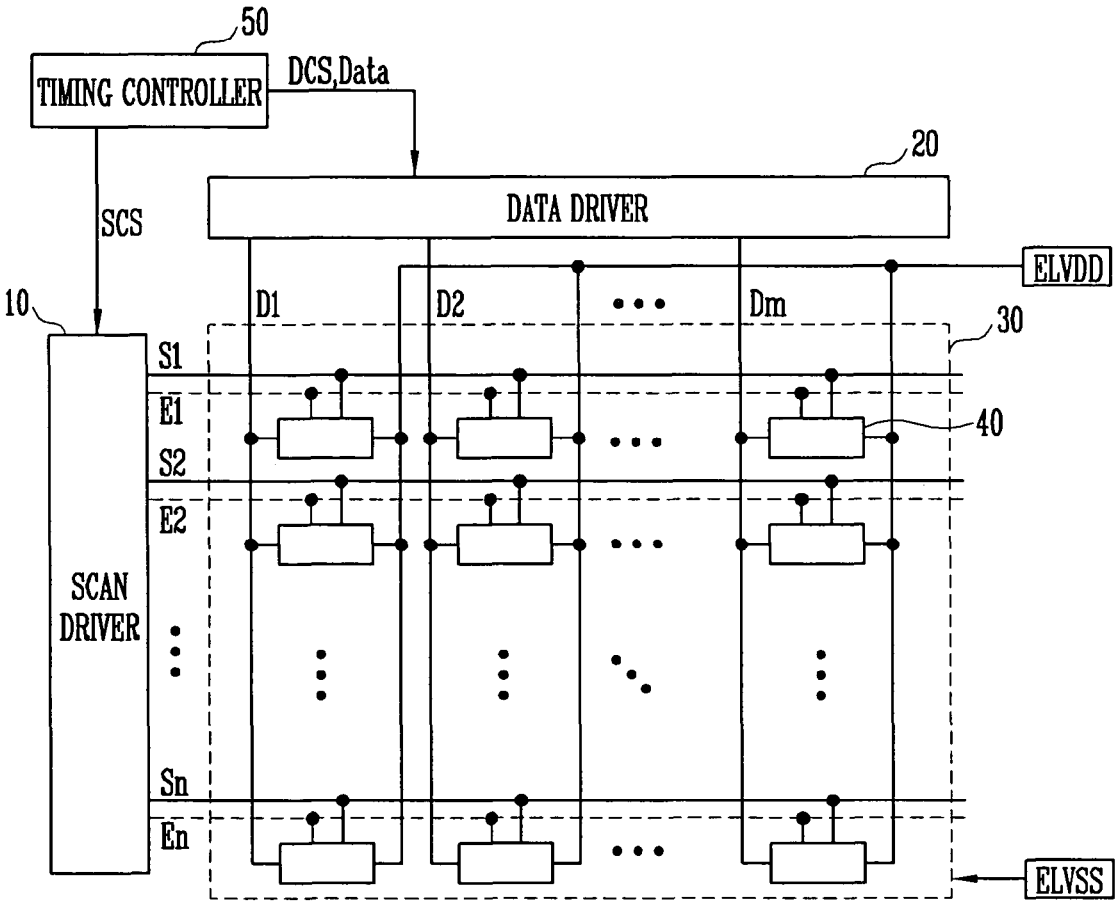
FIG. 1 (PRIOR ART)
FIG. 1 is a diagram showing a conventional organic light emitting display device.
Figure 2:
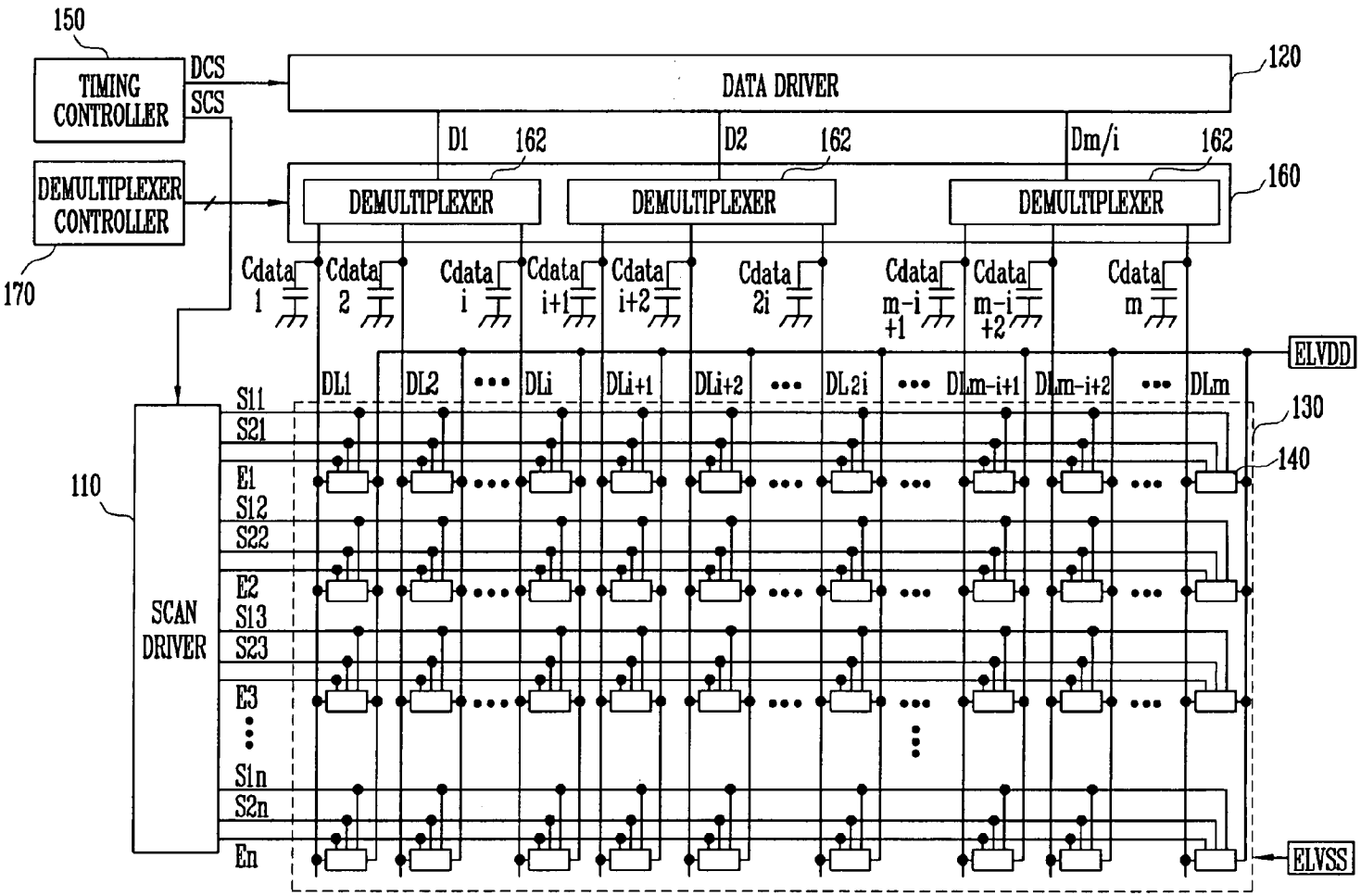
FIG. 2 is a diagram showing an organic light emitting display device according to an embodiment of the present invention.

FIG. 2 is a diagram showing an organic light emitting display device according to an embodiment of the present invention.

Referring to FIG. 2, the organic light emitting display device includes a scan driver 110, a data driver 120, a display region 130, a timing controller 150, a demultiplexer unit 160, a demultiplexer controller 170, and a plurality of data capacitors Cdata.

The display region 130 includes a plurality of pixels 140, each of which is arranged to be connected with one of first scan lines S11, S12, . . . , S1n, one of second scan lines S21, S S2n, one of light emitting control lines E1, E2, . . . , En, and one of data lines DL1, DL2, . . . , DLm. Each of the pixels 140 generates light according to data signals supplied on the data lines DL.

The timing controller 150 generates data driving control signals DCS and scan driving control signals SCS corresponding to synchronization signals which may be externally provided. The data driving control signals DCS are supplied to the data driver 120, and the scan driving control signals SCS are supplied to the scan driver 110.

The scan driver 110 is supplied with the scan driving control signals SCS received from the timing controller 150. The scan driver 110 sequentially supplies first scan signals to the first scan lines S11, S12, . . . , S1n and second scan signals to the second scan lines S21, S22, . . . , S2n. Where one of the first scan lines and one of the second scan lines are connected with one of the pixels 140, the first scan signal and the second scan signal are respectively supplied to the one of the first scan lines and the one of the second scan lines starting at substantially the same time. The width of the first scan signal is configured to be wider than that of the second scan signal (see FIG. 4A, for example). In addition, the scan driver 110 generates light emitting control signals according to the scan driving control signals SCS, and sequentially supplies the light emitting control signals to light emitting control lines E1, E2, . . . , En. The supplying of the light emitting control signals overlaps with the supplying of the first scan signals. The width of one of the light emitting control signals is configured to be wider than that of a corresponding one of the first scan signals (see FIG. 4A, for example).

Figure 4A:
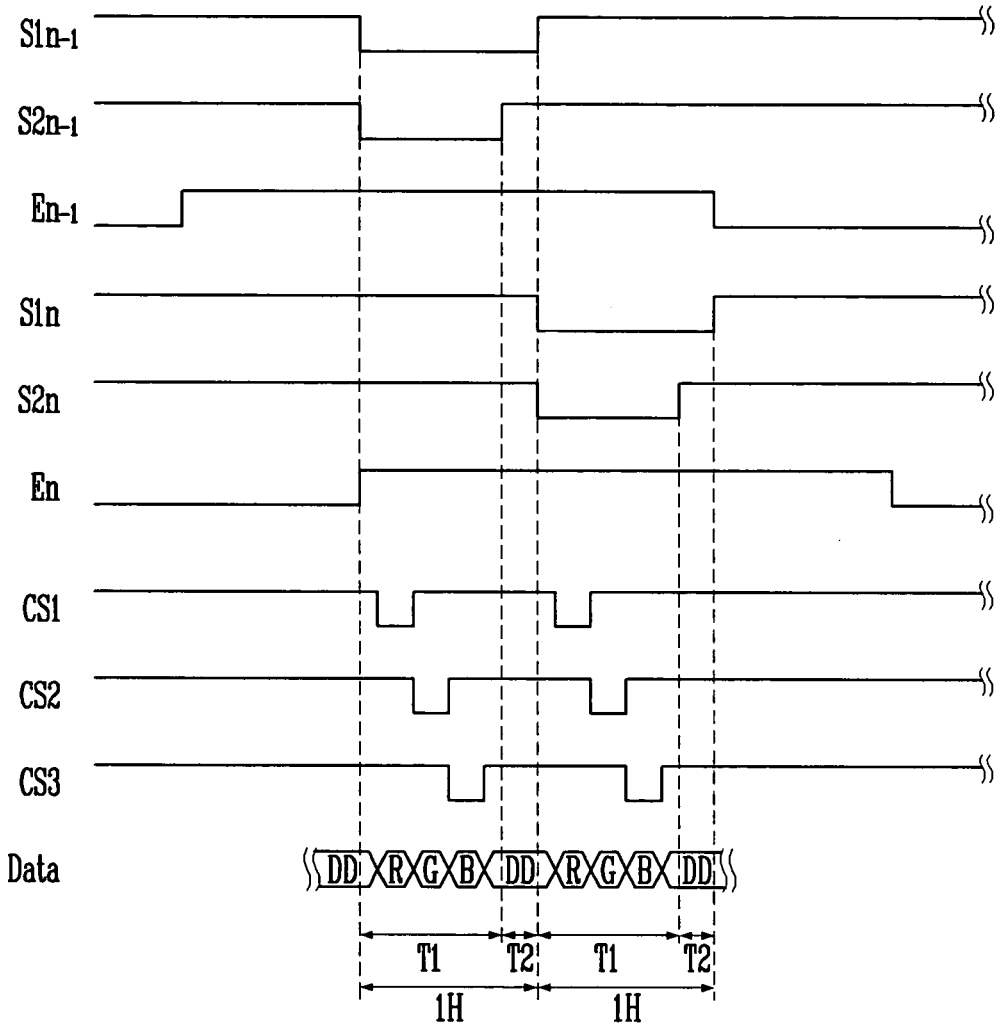
FIGS. 4A and 4B are waveform diagrams showing operation of the organic light emitting display device shown in FIG. 2.

More specifically, as shown in FIG. 4A, a first horizontal period 1H is divided into a first period T1 and a second period T2. The scan driver 110 supplies the first scan signal and the second scan signal to a corresponding one of the first scan lines and a corresponding one of the second scan lines, respectively, during the first period T1, and supplies only the first scan signal to the corresponding one of the first scan lines during the second period T2. The scan driver 110 supplies the light emitting control signal to a corresponding one of the light emitting control lines during the first period T1 and the second period T2.

Figure 4B:
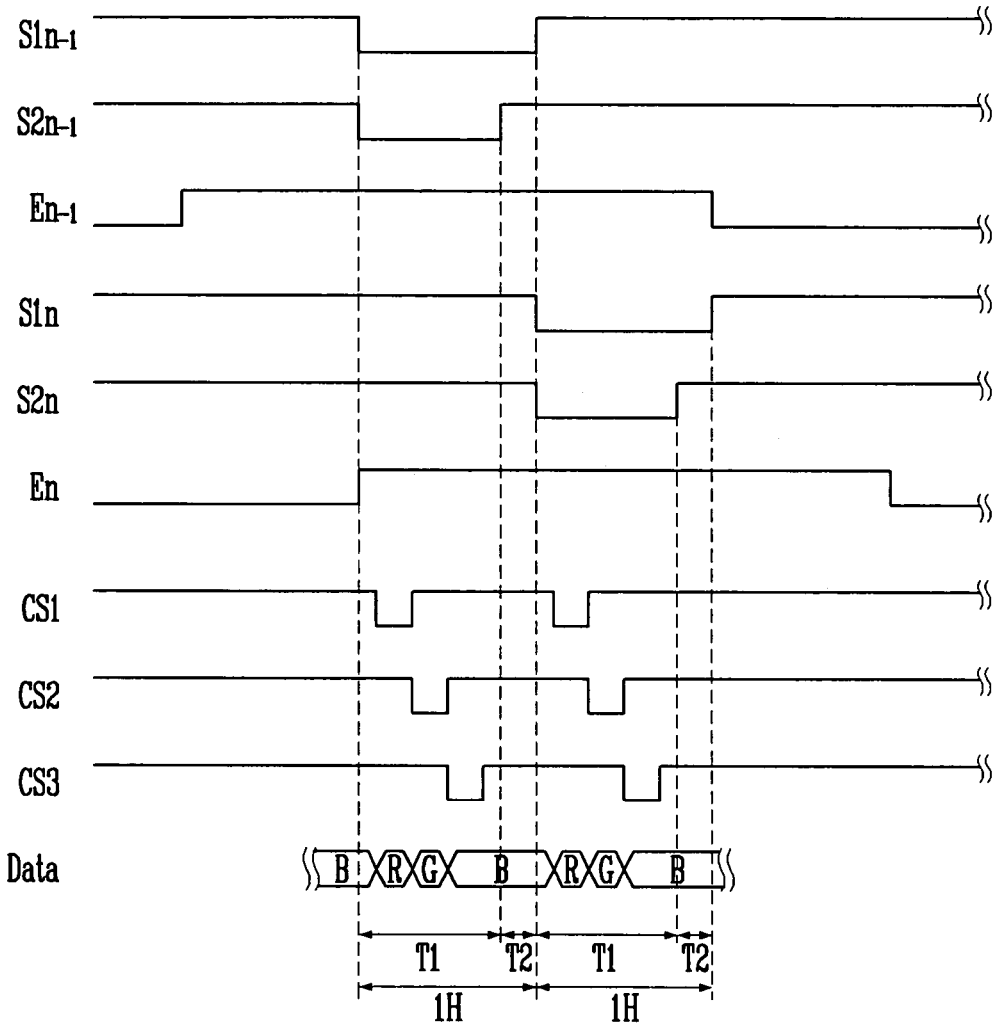

The data driver 120 is supplied with the data driving control signals DCS from the timing controller 150. As shown in FIGS. 4A and 4B, the data driver 120 supplies data signals to output lines D1, D2, . . . , Dm/i. The data driver 120 supplies, in a sequential order, j (where, j is an integer number equal to or larger than 2) data signals to each of the output lines D1, D2, . . . , Dm/i.

More specifically, the data driver 120 supplies, in sequential order, data signals R, G, and B (to be supplied to corresponding pixels) during the first period T1 of the first horizontal period 1H. That is, the data signals R, G, and B are supplied during the first period T1 when both the first scan signal and the second scan signal are supplied. The data driver 120 then supplies a dummy data signal DD during the second period T2 of the first horizontal period 1H. The dummy data signal DD does not contribute to a displayed image or images, and therefore the dummy data signal DD may be configured randomly. As such, as shown in FIG. 4*b*, the dummy data signal DD may be configured using the data signal B which was supplied last in the sequential order. In the case where the dummy data signal DD is implemented using the data signal B, a switching frequency of the data driver 120 is reduced, thereby resulting in a reduced consumption of power.

The demultiplexer unit 160 includes m/i demultiplexers 162. In other words, the demultiplexer unit 160 includes a plurality of demultiplexers 162 equal in number to that of the output lines D1, D2, . . . , Dm/i. Each of the demultiplexers 162 is connected to one of the output lines D1, D2, . . . , Dm/i. Each of the demultiplexers 162 supplies j data signals supplied during a first period T1 to j data lines DL.

As such, in the case where data signals supplied via one output line D are supplied over j data lines DL, the output lines that the data driver 120 is required to drive decreases in number. For example, assuming that j is equal to 3, the number of output lines that the data driver 120 is required to drive is decreased by a factor of 3, which accordingly reduces the number of data driving circuits required to be included in the data driver 120. That is, one aspect of the present invention is a reduction in manufacturing cost arising by supplying data signals from one output line D to j data lines DL using one of the demultiplexers 162.

The demultiplexer controller 170 supplies j control signals to each one of the demultiplexers 162 during the first period T1 of the first horizontal period so that each of j data signals supplied over the one output line D is supplied to a respective one of the j data lines DL. As shown in FIGS. 4A and 4B, j control signals supplied from the demultiplexer controller 170 are sequentially supplied such that they are not overlapping. Although FIG. 2 shows that the demultiplexer controller 170 is implemented outside the timing controller 150, in a further embodiment, the demultiplexer controller 170 may be implemented inside the timing controller 150.

One of the data capacitors Cdata is electrically arranged on each data line DL. The data capacitors Cdata temporarily store data signals supplied to the data lines DL, and supplies the stored data signals to the pixels 140. The data capacitors Cdata may be implemented by parasitic capacitors generated in the data lines DL. In addition, external capacitors may be additively installed in each of the data lines DL to implement the data capacitors Cdata. The capacitance of one of the data capacitors Cdata is configured to be greater than the capacitance of a storage capacitor C included in a corresponding pixel (see, for example, FIG. 5).

Figure 3:
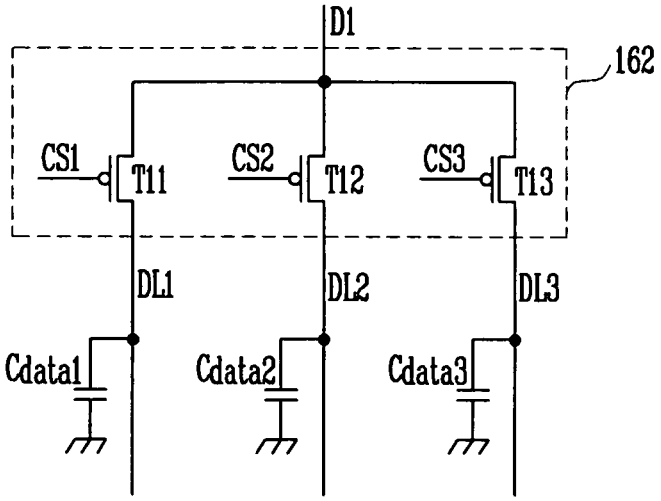
FIG. 3 is a circuit diagram of a demultiplexer shown in FIG. 2.

FIG. 3 is a is a circuit diagram of the demultiplexer shown in FIG. 2.

For purposes of description, it is assumed that j is equal to 3. For purposes of description, it is also assumed that the demultiplexer shown in FIG. 3 is connected to the first output line D1.

Referring to FIG. 3, the demultiplexer 162 includes a first switching element T11 (e.g., a transistor), a second switching element T12, and a third switching element T13.

The first switching element T11 is connected between the first output line D1 and the first data line DL1. The first switching element T11 is turned on when the first control signal CS1 is supplied. When the first switching element T11 is turned on, the first switching element T11 supplies the data signal supplied over the first output line D1 to the first data line DL1. The data signal supplied to the first data line DL1 is supplied to a corresponding one of the pixels 140 and also stored in the first data capacitor Cdata1.

The second switching element T12 is connected between the first output line D1 and the second data line DL2. The second switching element T12 is turned on when the second control signal CS2 is supplied. When the second switching element T12 is turned on, the second switching element T12 supplies the data signal supplied over the first output line D1 to the second data line DL2. The data signal supplied to the second data line DL2 is supplied to a corresponding one of the pixels 140 and also stored in the second data capacitor Cdata2.

The third switching element T13 is connected between the first output line D1 and the third data line DL3. The third switching element T13 is turned on when the third control signal CS3 is supplied. When the third switching element T13 is turned on, the third switching element T13 supplies the data signal supplied over the first output line D1 to the third data line DL3. The data signal supplied to the third data line DL3 is supplied to a corresponding one of the pixels 140 and also stored in the third data capacitor Cdata3. Operation of the demultiplexer 162 will later be described in more detail.

Figure 5:
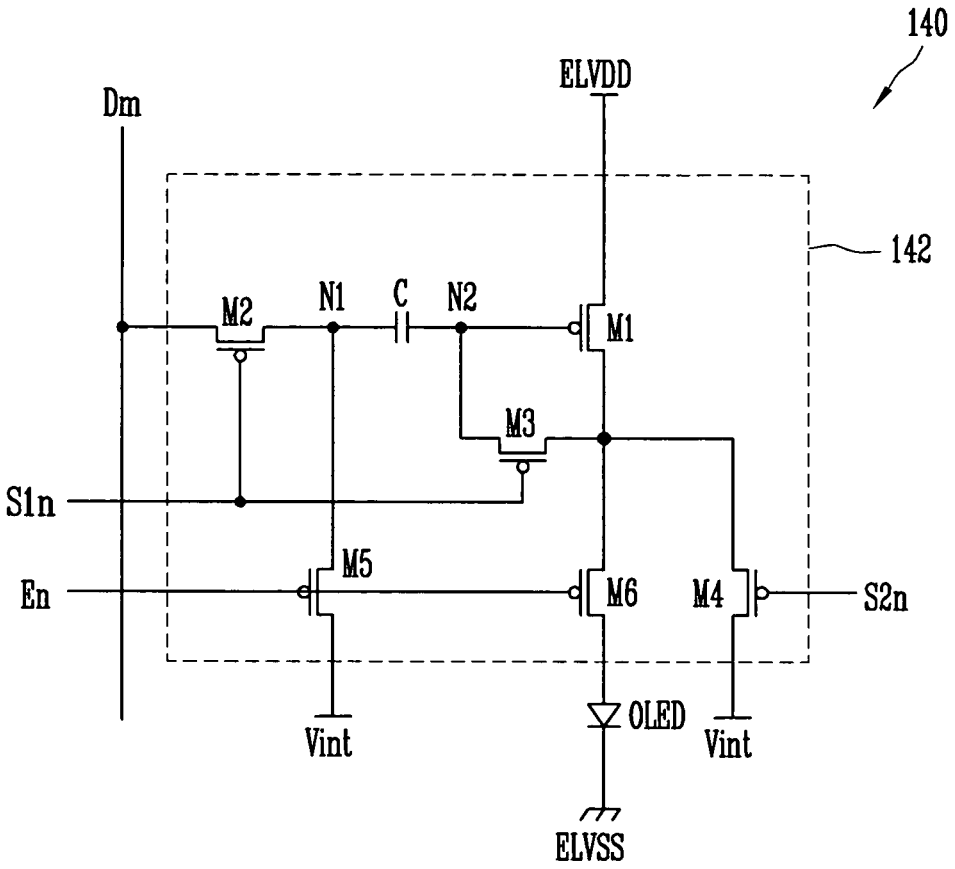
FIG. 5 is a circuit diagram of a pixel shown in FIG. 2.

FIG. 5 is a circuit diagram of a pixel shown in FIG. 2. For purposes of description, FIG. 5 shows a pixel connected to the mth data line Dm, the first scan line S1n, the second scan line S2n, and the nth light emitting scan line En.

Referring to FIG. 5, the pixel of the present invention includes an organic light emitting diode (OLED) and a pixel circuit 142. The pixel is connected to the data line Dm, the first scan line S1n, the second scan line S2n and the light emitting control line En, so that a level of current supplied to the OLED can be controlled.

An anode electrode of the OLED is connected to the pixel circuit 142, and a cathode electrode of the OLED is connected to the second power source ELVSS. The value (or voltage value) of the second power source ELVSS is set to be lower than that of the first power source ELVDD. The organic light emitting diode OLED generates light of a predetermined (or certain) brightness corresponding to the level of current supplied from the pixel circuit 142 to the OLED.

The pixel circuit 142, when scan signals are supplied to the first scan line S1n and the second scan line S2n and when data signals are supplied from the data line Dm, controls the amount of current supplied to the OLED corresponding to the data signals. The pixel circuit 142 includes a first transistor (or driving transistor) M1, a second transistor M2, a third transistor M3, a fourth transistor M4, a fifth transistor M5, a sixth transistor M6 and a storage capacitor C.

A first electrode of the second transistor M2 is connected to the data line Dm, and a second electrode of the second transistor M2 is connected to a first node N1. A gate electrode of the second transistor M2 is connected to the first scan line S1n. When the first scan signal is supplied to the first scan line S1n, the second transistor M2 is turned on and supplies the data signal supplied to the data line Dm to the first node N1.

A first electrode of the first transistor M1 is connected to the first power source ELVDD, and a second electrode of the first transistor M1 is connected to a first electrode of the sixth transistor M6. A gate electrode of the first transistor M1 is connected to a second node N2. The first transistor M1 supplies a current corresponding to a voltage applied to the second node N2 to the sixth transistor M6.

A first electrode of the third transistor M3 is connected to the second electrode of the first transistor M1, and a second electrode of the third transistor M3 is connected to the gate electrode of the first transistor M1. A gate electrode of the third transistor M3 is connected to the first scan line S1n. When the first scan signal is supplied to the first scan line S1n, the third transistor M3 is turned on and connects the first transistor M1 in a diode form.

A first electrode of the fourth transistor M4 is connected to the second electrode of the first transistor M1, and a second electrode of the fourth transistor M4 is connected to an initialization power source Vint. A gate electrode of the fourth transistor M4 is connected to the second scan line S2n. When the second scan signal is supplied to the second scan line S2n, the fourth transistor M4 is turned on.

A first electrode of the fifth transistor M5 is connected to the first node N1, and a second electrode of the fifth transistor M5 is connected to an initialization power source Vint. A gate electrode of the fifth transistor M5 is connected to the light emitting control line En. When the light emitting control signal is not supplied to the light emitting control line En, the fifth transistor M5 is turned on and brings the value of the voltage of the first node N1 to the value of the voltage of the initialization power source Vint.

The first electrode of the sixth transistor M6 is connected to the second electrode of the first transistor M1, and a second electrode of the sixth transistor M6 is connected to the anode electrode of the OLED. A gate electrode of the sixth transistor M6 is connected to the light emitting control line En. When the light emitting control signal is not supplied to the light emitting control line En, the sixth transistor M6 is turned on and supplies the current supplied from the first transistor M1 to the OLED.

The storage capacitor C is connected between the first node N1 and second node N2 and is charged according to a predetermined (or certain) voltage (or voltage potential) between the first node N1 and the second node N2.

Figure 6:
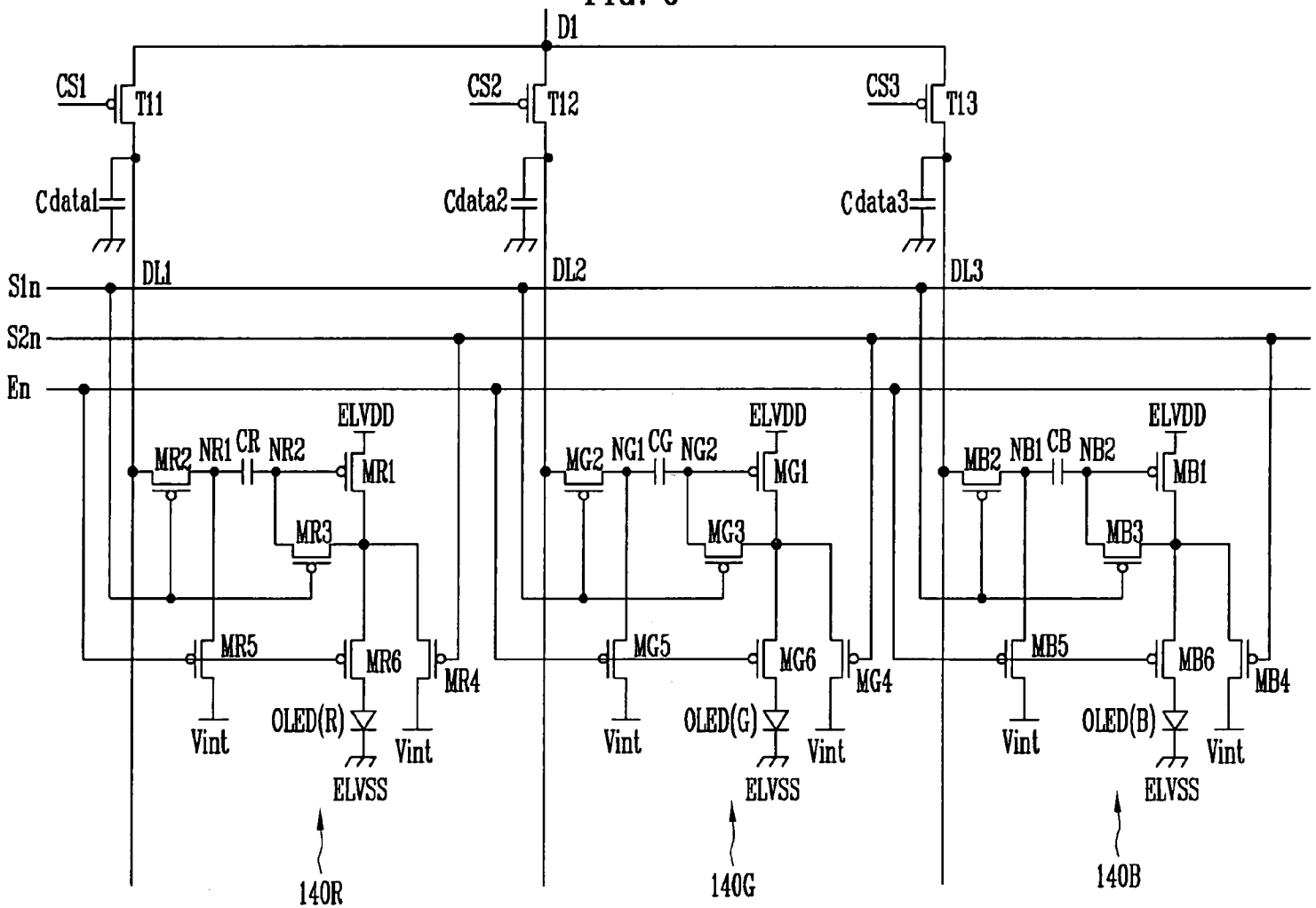
FIG. 6 is a circuit diagram showing connections between the demultiplexer and a subset of pixels.

FIG. 6 is a circuit diagram showing connections between a demultiplexer and a subset of the plurality of pixels. For purposes of description, it is assumed that a red pixel 140R, a green pixel 140G and a blue pixel 140B are connected to the multiplexer (i.e., j=3).

Referring to FIGS. 4A and 6, during the frst period T1 of the horizontal period 1H, the first scan signal is supplied to the first scan line S1n, and the second scan signal is supplied to the second scan line S2n. If the first scan signal and the second scan signal are so supplied, then the second transistor MR2, the third transistor MR3 and the fourth transistor MR4 of the red pixel 140R are turned on. Similarly, the second transistor MG2, the third transistor MG3 and the fourth transistor MG4 of the green pixel 140G are turned on. Similarly, the second transistor MB2, the third transistor MB3 and the fourth transistor MB4 of the blue pixel 140B are turned on. In sequential order during the first period T1, the first switching element T11 is turned on by the first control signal CS1, the second switching element T12 is turned on by the second control signal CS2, and the third switching element T13 is turned on by the third control signal CS3.

The first switching element T11 is turned on by the first control signal CS1, and a data signal R is supplied to the first output line D1. The data signal R is accordingly supplied to the first data line DL1. The data signal R is then stored in the first data capacitor Cdata1 and also supplied to the first node NR1 of the red pixel 140R. The voltage of the first node NR1 is brought to the value of the voltage of the data signal R, and the second node NR2 is brought to the value of the voltage the initialization power source Vint.

The first switching element T11 is turned off by the first control signal CS1. Then, the second switching element T12 is turned on by the second control signal CS2, and a data signal G is supplied to the first output line D1. The data signal G is accordingly supplied to the second data line DL2. The data signal G is then stored in the second data capacitor Cdata2 and also supplied to the first node NG1 of the green pixel 140G. Then, the voltage of the first node NG1 is brought to the voltage of the data signal G, and the second node NG2 is brought to the voltage of the initialization power source Vint.

The second switching element T12 is turned off by the second control signal CS2. Then, the third switching element T13 is turned on by the third control signal CS3, and a data signal B is supplied to the first output line D1. The data signal B is accordingly supplied to the third data line DL3. The data signal B is then stored in the third data capacitor Cdata3 and also supplied to the first node NB1 of the blue pixel 140B. Then, the voltage of the first node NB1 is brought to the value of the voltage of the data signal B, and the voltage of the second node NB2 is brought to the value of the voltage of the initialization power source Vint.

During the second period T2, the second scan signal is not supplied to the second scan line S2n. Accordingly, the fourth transistor MR4 of the pixel 140 R, the fourth transistor MG4 of the pixel 140G, and the fourth transistor MB4 of the pixel 140B are turned off. The third transistors MR3, MG3 and MB3 remain turned on to connect the driving transistors MR1, MG1 and MB1, respectively, in a diode form. Because the driving transistor MR1 is connected in the diode form, the value of the voltage of the second node NR2 is brought to the value of the voltage of the first power source ELVDD minus the threshold voltage of the driving transistor MR1. That is, the threshold voltage of the driving transistor MR1 is compensated during the second period T2. The value of the voltage at the first node NR1 is held at the value of the voltage of the data signal R according to the voltage stored in the data capacitor Cdata1.

Similarly, because the driving transistor MG1 is connected in the diode form, the value of the voltage of the second node NG2 is brought to the value of the voltage of the first power source ELVDD minus the threshold voltage of the driving transistor MG1. That is, the threshold voltage of the driving transistor MG1 is compensated during the second period T2. The value of the voltage at the first node NG1 is held at the value of the voltage of the data signal G according to the voltage stored in the data capacitor Cdata2.

Similarly, because the driving transistor MB1 is connected in the diode form, the value of the voltage of the second node NB2 is brought to the value of the voltage of the first power source ELVDD minus the threshold voltage of the driving transistor MB1. That is, the threshold voltage of the driving transistor MB1 is compensated during the second period T2. The value of the voltage at the first node NB1 is held at the value of the voltage of the data signal B according to the voltage stored in the data capacitor Cdata3.

At the end of the second period T2, the first scan signal is not supplied to the first scan line S1n. Accordingly the second transistor MR2 and the third transistor MR3 of the pixel 140R are turned off. Similarly, the second transistor MG2 and the third transistor MG3 of the pixel 140G and the second transistor MB2 and the third transistor MB3 of the pixel 140B are turned off. Then, the light emitting control signal is not supplied to the light emitting control line En. Accordingly, the fifth transistor MR5 and the sixth transistor MR6 of the pixel 140R, the fifth transistor MG5 and the sixth transistor MG6 of the pixel 140G and the fifth transistor MB5 and the sixth transistor of the pixel 140B are turned on.

When the fifth transistor MR5 of the pixel 140R is turned on, the value of the voltage of the first node NR1 of the pixel 140R is pulled down to the value of the voltage of the initialization power source Vint. In other words, the value of the voltage of the first node NR1 falls from the value of the voltage of the data signal R to the value of the voltage of the initialization power source Vint. Because the second node NR2 of the pixel 140R is in a floating state, the value of the voltage of the second node NR2 also falls correspondingly according to the value of the voltage of the first node NR1. For example, the value of the voltage of the second node NR2 falls from the value of the voltage of the first power source ELVDD minus the threshold voltage of the first transistor MR1 to the value of the voltage of the data signal R.

Similarly, when the fifth transistor MG5 of the pixel 140G is turned on, the value of the voltage of the first node NG1 of the pixel 140G is pulled down to the value of the voltage of the initialization power source Vint. In other words, the value of the voltage of the first node NG1 falls from the value of the voltage of the data signal G to the value of the voltage of the initialization power source Vint. Because the second node NG2 of the pixel 140G is in a floating state, the value of the voltage of the second node NG2 also falls correspondingly according to the value of the voltage of the first node NG1. For example, the value of the voltage of the second node NG2 falls from the value of the voltage of the first power source ELVDD minus the threshold voltage of the first transistor MG1 to the value of the voltage of the data signal G.

Similarly, when the fifth transistor MB5 of the pixel 140B is turned on, the value of the voltage of the first node NB1 of the pixel 140B is pulled down to the value of the voltage of the initialization power source Vint. In other words, the value of the voltage of the first node NB1 falls from the value of the voltage of the data signal B to the value of the voltage of the initialization power source Vint. Because the second node NB2 of the pixel 140B is in a floating state, the value of the voltage of the second node NB2 also falls correspondingly according to the value of the voltage of the first node NB1. For example, the value of the voltage of the second node NB2 falls from the value of the voltage of the first power source ELVDD minus the threshold voltage of the first transistor MB1 to the value of the voltage of the data signal B.

Then, the first transistor MR1 of the pixel 140R, supplies current corresponding to the value of the voltage applied to the second node NR2. The current is supplied via the sixth transistor MR6 to the OLED(R), which accordingly generates light of a predetermined or certain brightness. The level of the current supplied from the first transistor MR1 is determined by the voltage of the data signal R. In other words, because the value of the voltage at the second node NR2 is determined by the value of the voltage of the data signal R, the level of the current supplied to the OLED(R) is determined by the data signal R. In addition, because the initial value of the voltage of the second node NR2 is determined as the value of the voltage of the first power source ELVDD minus the threshold voltage of the first transistor MR1, the display region 130 may display uniformly bright images independent of the threshold voltage of the first transistor MR1.

Similarly, the first transistor MG1 of the pixel 140G, supplies current corresponding to the value of the voltage applied to the second node NG2. The current is supplied via the sixth transistor MG6 to the OLED(G), which accordingly generates light of a predetermined or certain brightness. The level of the current supplied from the first transistor MG1 is determined by the voltage of the data signal G. In other words, because the value of the voltage at the second node NG2 is determined by the value of the voltage of the data signal G, the level of the current supplied to the OLED(G) is determined by the data signal G. In addition, because the initial value of the voltage of the second node NG2 is determined as the value of the voltage of the first power source ELVDD minus the threshold voltage of the first transistor MG1, the display region 130 may display uniformly bright images independent of the threshold voltage of the first transistor MG1.

Similarly, the first transistor MB1 of the pixel 140B, supplies current corresponding to the value of the voltage applied to the second node NB2. The current is supplied via the sixth transistor MB6 to the OLED(B), which accordingly generates light of a predetermined or certain brightness. The level of the current supplied from the first transistor MB1 is determined by the voltage of the data signal B. In other words, because the value of the voltage at the second node NB2 is determined by the value of the voltage of the data signal B, the level of the current supplied to the OLED(B) is determined by the data signal B. In addition, because the initial value of the voltage of the second node NB2 is determined as the value of the voltage of the first power source ELVDD minus the threshold voltage of the first transistor MB1, the display region 130 may display uniformly bright images independent of the threshold voltage of the first transistor MB1.

As such, an advantage of embodiments of the present invention is a reduction in manufacturing costs arising by supplying data signals supplied over one output line D to j data lines DL using a demultiplexer. Embodiments of the present invention may also display images in a stable manner through maintainance of a value of a voltage at a first node N1 according to the value of a voltage of a data signal stored in a data capacitor. Furthermore, a fourth transistor M4 that supplies an initialization power source to the pixels is connected to a second electrode of a first transistor M1. Therefore, embodiments of the present invention prevent leakage current from flowing from a gate electrode of the first transistor M1 to the initialization power source, thus making it possible to display images at a desired brightness.

Figure 7:
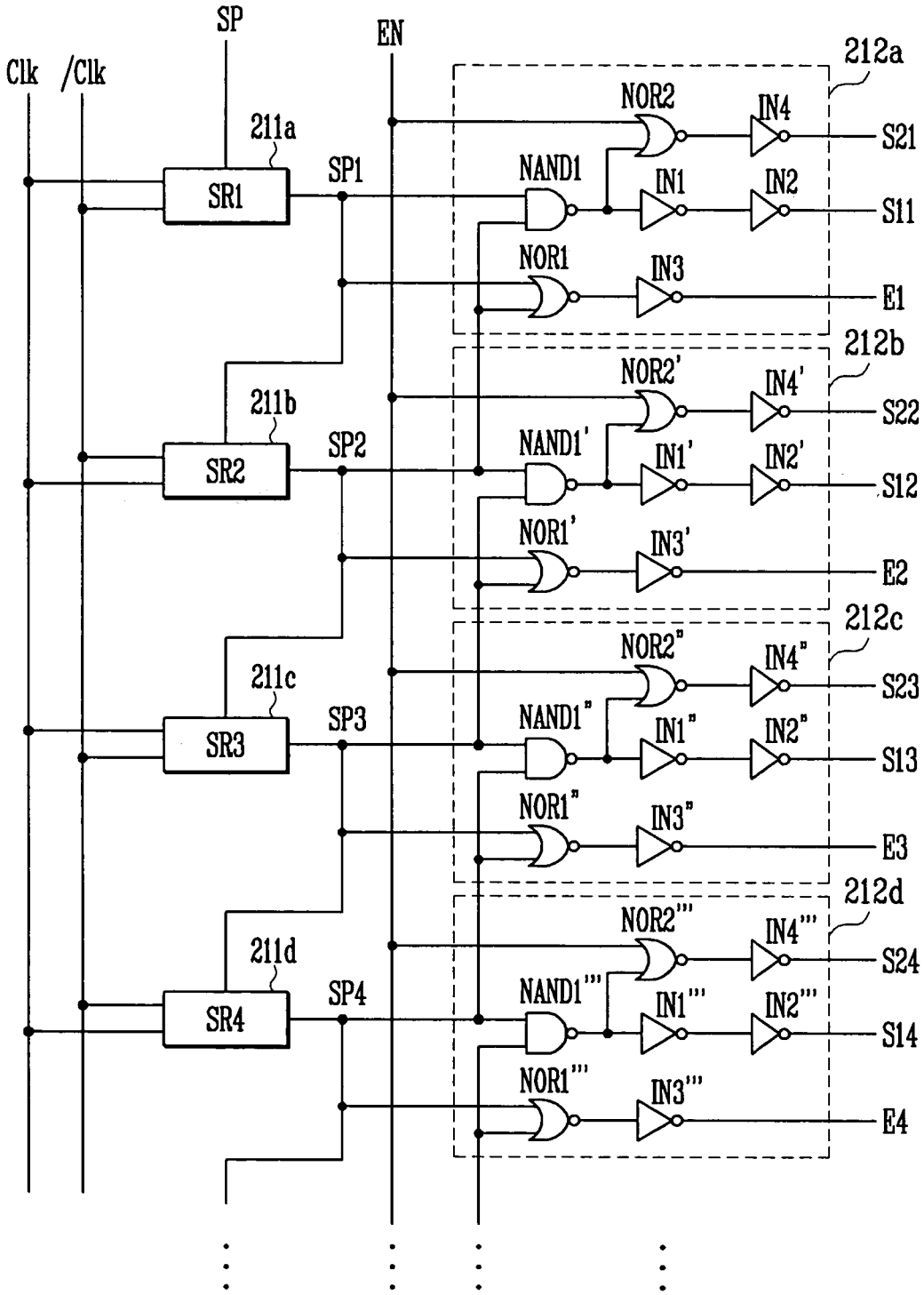
FIG. 7 is a circuit diagram of an embodiment of the scan driver shown in FIG. 2.
Figure 8:
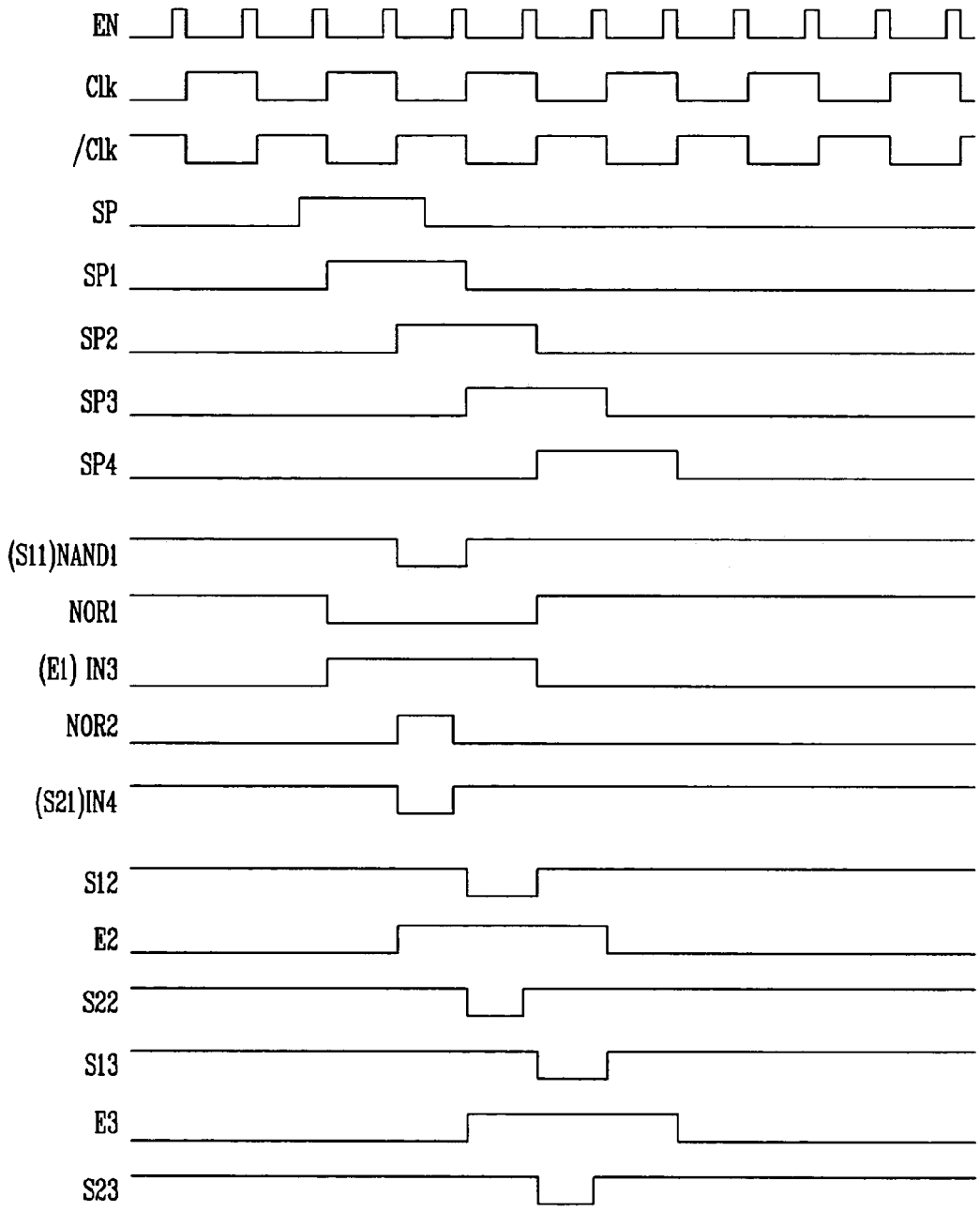
FIG. 8 is a waveform diagram showing an operation of the embodiment of the scan driver shown in FIG. 7.

FIG. 7 is a circuit diagram of an embodiment of the scan driver shown in FIG. 2. FIG. 8 is a waveform diagram showing an exemplary operation of the scan driver.

Referring to FIGS. 7 and 8, the scan driver of an embodiment of the present invention includes shift registers 211*a*, 211*b*, etc . . . for sequentially generating sampling pulses SP1, SP2, etc . . . , and signal generation parts 212*a*, 212*b*, . . . each of which generate a first scan signal, a second scan signal, and a light emitting control signal by performing logic operations on two of the sampling pulses.

As shown in FIG. 8, the shift registers 211*a*, 211*b*, etc . . . , sequentially generate the sampling pulses SP1, SP2, etc. . . . Shift registers 211*a*, 211*c*, etc . . . that are driven by rising edges of a clock signal Clk and shift registers 211*b*, 211*d*, etc . . . that are driven by falling edges of the clock signal Clk are arranged alternatingly.

More specifically, the first shift register 211*a* is supplied with a start pulse SP which may be externally provided. The first shift register 211*a* is driven by the rising edge of the clock signal Clk and, correspondingly, a falling edge of a clock bar signal/Clk to generate the first sampling pulse SP1. The first sampling pulse SP1 is output for a period of the clock signal Clk (i.e. until the start pulse SP stops being supplied and a subsequent rising edge of the clock signal Clk occurs).

The second shift register 211*b* is supplied with the first sampling pulse SP1 and is driven by a falling edge of the clock signal Clk and, correspondingly, a rising edge of the clock bar signal /Clk to generate the second sampling pulse SP2. The second sampling pulse SP2 is output for a period of the clock signal Clk. According to the procedure described above, the shift registers 211*a*, 211*b*, 211*c*, etc . . . respectively generate the sampling pulses SP1, SP2, SP3, etc. . . .

Signal generation parts 212*a*, 212*b*, 212*c*, etc. are each connected to output terminals of two (or adjacent) shift registers of the shift registers 211*a*, 211*b*, 211*c*, etc. . . . Each of the signal generation parts 212*a*, 212*b*, 212*c*, etc . . . generate a first scan signal, a second scan signal, and a light emitting control signal by performing logic operations on the respective sampling signals of the corresponding two adjacent shift registers (e.g., 211*a* and 211*b*).

As shown in FIG. 8, the first signal generation part 212*a* includes a first NAND gate NAND1, a first NOR gate NOR1, a second NOR gate NOR2, and inverters IN1, IN2, IN3, and IN4.

The first NAND gate NAND1 performs a NAND operation on the first sampling pulse SP1 and the second sampling pulse SP2. As shown in FIG. 8, signals of a low logic level are output by the first NAND gate NAND1 when the first sampling pulse SP1 and the second sampling pulse SP2 have high logic levels, and signals of a high logic level are output by the first NAND gate NAND1 otherwise. Here, the signal outputted from the first NAND gate NAND1 is supplied as the first scan signal to the first scan line S11 either directly or via at least one pair of inverters (i.e. IN1 and IN2).

The first NOR gate NOR1 performs a NOR operation on the first sampling pulse SP1 and the second sampling pulse SP2. Then, as shown in FIG. 9, signals of a low logic level are outputted by the first NOR gate NOR1 when at least either of the first sampling pulse SP1 or the second sampling pulse SP2 has a high logic level, and signals of a high logic level are outputted by the first NOR gate NOR1 otherwise. The signal outputted by the first NOR gate NOR1 is supplied as the light emitting control signal via the inverter IN3 to the light emitting control line E1.

The second NOR gate NOR2 performs a NOR operation on the output of the first NAND gate NAND1 and an enable signal EN. Here, one period of the enable signal EN is configured to have a duration substantially equal to half that of a period of the clock signal Clk. During a period of the enable signal EN, the enable signal EN has a high logic level and then a low logic level. In a further embodiment, the duration in which the enable signal EN has a high logic level is configured to be shorter than the duration in which the enable signal EN has a low logic level.

As shown in FIG. 8, the second NOR gate NOR2 outputs a signal of a high logic level when the output of the first NAND gate NAND1 and the enable signal have a low logic level, and outputs a signal of a low logic level otherwise. The signal output by the second NOR gate NOR2 is supplied as the second scan signal via the inverter IN4 to the scan line S21.

As such, each of the signal generation parts 212*a*, 212*b*, 212*c*, etc . . . generate a first scan signal, a second scan signal, and a light emitting control signal by performing the aforementioned procedure, i.e. performing logic operations on sampling signals produced by two adjacent shift registers. In other words, a scan driver (such as the scan driver 110 shown in FIG. 2) may generate the first scan signals, the second scan signals and the light emitting control signals in a stable manner to drive the pixels 140. By means of only the scan driver, the first scan signal, the second scan signal, and the light emitting control signal are generated, and therefore it is possible to simplify the circuit.

As mentioned above, the scan driver and organic light emitting display device according to embodiments of the present invention may supply data signals supplied over one output line to multiple data lines, which may decrease the number of output lines required, thus making it possible to reduce manufacturing costs. Further, embodiments of the present invention may produce stable driving of pixels because the data signals are stored in data capacitors and then the stored data signals are supplied when first scan signals are supplied. In addition, because in embodiments of the present invention, gate electrodes of driving transistors are not connected to transistors for supplying voltages for an initialization power source, it is possible to prevent leakage current from being generated, thus making it possible to display images at a desired brightness. Furthermore, in embodiments of the present invention, the scan driver may generate first scan signals, second scan signals and light emitting control signals in a stable manner, to accordingly drive the pixels in a stable manner.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for sequentially supplying a plurality of first scan signals to a plurality of first scan lines, sequentially supplying a plurality of second scan signals to a plurality of second scan lines, and sequentially supplying a plurality of light emitting control signals to a plurality of light emitting control lines, the scan driver being adapted to supply one of the first scan signals to a first scan line of the plurality of first scan lines during a first period and a second period of a horizontal period, the second period immediately following the first period, to supply one of the second scan signals to a second scan line of the plurality of second scan lines during the first period, the one of the first scan signals and the one of the second scan signals being supplied starting at substantially the same time, and to supply one of the light emitting control signals to a corresponding one of the light emitting control lines during a period at least spanning the first period and the second period;

a data driver for supplying in a sequential order a plurality of data signals to at least one of a plurality of output lines, the data driver being adapted to supply the data signals to the at least one of the output lines during the first period;

a demultiplexer electrically coupled to the at least one of the output lines, the demultiplexer adapted to receive the data signals and supply the data signals to a plurality of data lines; and a plurality of pixels connected to the data lines, each of the pixels including a driving transistor and being adapted to receive a respective one of the data signals during the first period, to compensate a threshold voltage of the respective driving transistor during the second period, and to generate light having a brightness corresponding to the respective one of the data signals at a time after an end of the second period.

2. The organic light emitting display device according to claim 1, wherein:

the demultiplexer includes a plurality of switching elements, and each of the switching elements is connected to the at least one of the output lines and to a respective one of the data lines.

3. The organic light emitting display device according to claim 2, further comprising:

a demultiplexer controller for supplying control signals to the demultiplexer, wherein the control signals are adapted to sequentially turn on the plurality of switching elements during the first period.

4. The organic light emitting display device according to claim 3, wherein:

the data driver supplies to the at least one of the output lines a dummy data signal during the second period, and the brightness of light generated by each of the pixels does not correspond to the dummy signal supplied during the second period.

5. The organic light emitting display device according to claim 4, wherein the dummy data signal is substantially equal to a last one of the data signals supplied in the sequential order during the first period.

6. The organic light emitting display device according to claim 1, wherein each of the pixels further includes:

an organic light emitting diode;

the driving transistor having a driving transistor first electrode, a driving transistor second electrode, and a driving transistor gate electrode;

a second transistor having a second transistor first electrode, a second transistor second electrode, and a second transistor gate electrode;

a third transistor having a third transistor first electrode, a third transistor second electrode, and a third transistor gate electrode;

a fourth transistor having a fourth transistor first electrode, a fourth transistor second electrode, and a fourth transistor gate electrode;

a fifth transistor having a fifth transistor first electrode, a fifth transistor second electrode, and a fifth transistor gate electrode; and a storage capacitor having a storage capacitor first terminal and a storage capacitor second terminal, wherein the second transistor is connected to a corresponding first scan line of the first scan lines and to a corresponding data line of the data lines, the second transistor being adapted to turn on when a first scan signal of the first scan signals is supplied to the corresponding first scan line of the first scan lines and to supply a data signal on the corresponding data line of the data lines to a first node;

wherein the storage capacitor first terminal is connected to the first node, and the storage capacitor second terminal is connected to a second node;

wherein the driving transistor is adapted to supply a current corresponding to a value of a voltage applied to the second node via the organic light emitting diode to a power source;

wherein the third transistor is connected between the second node and the driving transistor second electrode and is adapted to turn on when the first scan signal of the first scan signals is supplied to the corresponding first scan line of the first scan lines and to connect the driving transistor in a diode form;

wherein the fourth transistor is connected between the driving transistor second electrode and an initialization power source and is adapted to turn on when a second scan signal of the second scan signals is supplied to a corresponding second scan line of the second scan lines; and wherein the fifth transistor is connected between the first node and the initialization power source and is adapted to turn on when a light emitting control signal of the light emitting control signals is not supplied to a corresponding light emitting control line of the light emitting control lines.

7. The organic light emitting display device according to claim 6, wherein during the second period, a value of a voltage at the second node is brought to a value of a voltage at the driving transistor first electrode minus a threshold voltage of the driving transistor.

8. The organic light emitting display device according to claim 7, wherein after the end of the second period, the fifth transistor is turned on and a value of a voltage at the first node falls from a voltage of the respective one of the data signals to a voltage of the initialization power source.

9. The organic light emitting display device according to claim 8, wherein after the end of the second period, the second node is in a floating state and the voltage of the second node falls corresponding to the falling of the voltage at the first node.

10. The organic light emitting display device according to claim 6, wherein each of the pixels further comprises:

a sixth transistor connected between the driving transistor second electrode and the organic light emitting diode, the sixth transistor being adapted to turn on when the light emitting control signal of the light emitting control signals is not supplied to the corresponding light emitting control line of the light emitting control lines.

11. An organic light emitting display device comprising:

a scan driver for sequentially supplying a plurality of first scan signals to a plurality of first scan lines, sequentially supplying a plurality of second scan signals to a plurality of second scan lines, and sequentially supplying a plurality of light emitting control signals to a plurality of light emitting control lines, the scan driver being adapted to supply one of the first scan signals to a first scan line of the plurality of first scan lines during a first period and a second period of a horizontal period, to supply one of the second scan signals to a second scan line of the plurality of second scan lines during the first period, and to supply one of the light emitting control signals to a corresponding one of the light emitting control lines during a period at least spanning the first period and the second period;

a data driver for supplying in a sequential order a plurality of data signals to at least one of a plurality of output lines, the data driver being adapted to supply the data signals to the at least one of the output lines during the first period;

a demultiplexer electrically coupled to the at least one of the output lines, the demultiplexer adapted to receive the data signals and supply the data signals to a plurality of data lines; and a plurality of pixels connected to the data lines, each of the pixels including a driving transistor and being adapted to receive a respective one of the data signals during the first period, to compensate a threshold voltage of the respective driving transistor during the second period, and to generate light having a brightness corresponding to the respective one of the data signals at a time after the end of the second period, wherein:

the scan driver includes a plurality of shift registers for sequentially generating sampling pulses, and a plurality of signal generation parts, each of the signal generation parts being adapted to generate a respective first scan signal of the first scan signals, a respective second scan signal of the second scan signals, and a respective light emitting control signal of the light emitting control signals by performing logic operations on sampling pulses produced by two adjacent shift registers of the plurality of shift registers, and each of the signal generation parts includes a first NAND gate for generating the respective first scan signal by performing logic operation on the sampling pulses produced by the two adjacent shift registers, a first NOR gate for generating the respective light emitting control signal by performing logic operation on the sampling pulses produced by the two adjacent shift registers, and a second NOR gate for generating the respective second scan signal by performing logic operation on an output of the first NAND gate and an externally provided enable signal.

12. The organic light emitting display device according to claim 11, wherein:

the shift registers are adapted to be driven by clock signals and clock bar signals, a first group of the shift registers are adapted to be driven by rising edges of the clock signals, a second group of the shift registers are adapted to be driven by falling edges of the clock signals, and shift registers of the first group and shift registers of the second group are alternately arranged.

13. The organic light emitting display device according to claim 12, wherein a duration of a period of the enable signal is configured to be substantially equal to ½ of a duration of a period of the clock signal.

14. The organic light emitting display device according to claim 13, wherein:

the period of the enable signal has a first portion and a second portion, the enable signal has a high logic output during the first portion and a low logic output during the second portion, and the first portion is shorter in duration than the second portion.

15. The organic light emitting display device according to claim 11, wherein each of the signal generation parts further includes at least one inverter connected to an output terminal of the first NAND gate.

16. The organic light emitting display device according to claim 11, wherein each of the signal generation parts further includes at least one inverter connected to an output terminal of the first NOR gate.

17. The organic light emitting display device according to claim 11, wherein each of the signal generation parts further includes at least one inverter connected to an output terminal of the second NOR gate.

18. An organic light emitting display device comprising:

a scan driver for sequentially supplying a plurality of first scan signals to a plurality of first scan lines, sequentially supplying a plurality of second scan signals to a plurality of second scan lines, and sequentially supplying a plurality of light emitting control signals to a plurality of light emitting control lines, the scan driver being adapted to supply each of the first scan signals to a respective first scan line of the plurality of first scan lines during a corresponding first period and a corresponding second period of a respective horizontal period, the corresponding second period immediately following the corresponding first period, to supply each of the second scan signals to a respective second scan line of the plurality of second scan lines during the corresponding first period, each of the first scan signals and each of the second scan signals corresponding thereto being supplied starting at substantially the same time, and to supply each of the light emitting control signals to a respective light emitting control line of the light emitting control lines during a respective period at least spanning the corresponding first period and the corresponding second period;

a data driver for supplying in a sequential order a plurality of data signals to a plurality of output lines, the data driver being adapted to supply in the sequential order each of a group of the data signals to a respective output line of the output lines during the corresponding first period;

a plurality of demultiplexers, each of the demultiplexers being electrically coupled to a corresponding one of the output lines and being adapted to receive a corresponding group of the data signals and to supply the corresponding group of the data signals to a corresponding group of the data lines; and a plurality of pixels, each of the pixels being connected to a respective one of the data lines, including a driving transistor, and being adapted to receive a corresponding data signal from the respective one of the data lines during the corresponding first period, to compensate a threshold voltage of the driving transistor during the corresponding second period, and to generate light having a brightness corresponding to the corresponding data signal at a time after an end of the corresponding second period.

* * * * *